US006509302B2

(12) United States Patent
Li et al.

(10) Patent No.: US 6,509,302 B2
(45) **Date of Patent: *Jan. 21, 2003**

(54) STABLE DISPERSION OF LIQUID HYDROPHILIC AND OLEOPHILIC PHASES IN A CONVEYOR LUBRICANT

(75) Inventors: Minyu Li, Oakdale, MN (US); Kimberly Person Hei, Baldwin, WI (US); Amy Haupert, St. Paul, MN (US)

(73) Assignee: Ecolab Inc., St. Paul, MN (US)

( * ) Notice: Subject to any disclaimer, the term of this patent is extended or adjusted under 35 U.S.C. 154(b) by 135 days.

This patent is subject to a terminal disclaimer.

(21) Appl. No.: 09/745,296

(22) Filed: Dec. 20, 2000

(65) Prior Publication Data

US 2002/0115574 A1 Aug. 22, 2002

(51) Int. Cl.[7] ..... C10M 105/14; C10M 173/00

(52) U.S. Cl. ..... 508/208; 508/485; 508/579; 508/583; 198/500

(58) Field of Search ..... 508/208

(56) References Cited

U.S. PATENT DOCUMENTS

| | | | | |
|---|---|---|---|---|
| 3,853,607 A | | 12/1974 | Iyengar et al. | 428/378 |
| 4,069,933 A | | 1/1978 | Newing | 215/12.2 |
| 4,252,528 A | | 2/1981 | Decker et al. | 8/115.6 |
| 4,343,616 A | | 8/1982 | Decker et al. | 8/115.6 |
| 4,478,889 A | | 10/1984 | Maruhashi et al. | 427/230 |
| 4,486,378 A | | 12/1984 | Hirata et al. | 264/512 |
| 4,515,836 A | | 5/1985 | Cobbs, Jr. et al. | 427/425 |
| 4,525,377 A | | 6/1985 | Nickel et al. | 427/532 |
| 4,534,995 A | | 8/1985 | Pocock et al. | 427/533 |
| 4,538,542 A | | 9/1985 | Kennon et al. | 118/302 |
| 4,543,909 A | | 10/1985 | Sharpless | 118/326 |
| 4,569,869 A | | 2/1986 | Kushida et al. | 428/35.7 |
| 4,573,429 A | | 3/1986 | Cobbs, Jr. et al. | 118/322 |
| 4,632,053 A | | 12/1986 | Villanueva et al. | 118/66 |
| 4,690,299 A | | 9/1987 | Cannon | 220/592.19 |
| 4,713,266 A | | 12/1987 | Hasegawa et al. | 427/412.5 |
| 4,714,580 A | | 12/1987 | Maruhashi et al. | 264/516 |
| 4,769,162 A | * | 9/1988 | Remus | 252/18 |
| 4,851,287 A | | 7/1989 | Hartsing, Jr. | 428/325 |
| 4,874,647 A | | 10/1989 | Yatsu et al. | 428/35.7 |
| 4,919,984 A | | 4/1990 | Maruhashi et al. | 428/36.4 |
| 4,980,211 A | | 12/1990 | Kushida et al. | 428/36.7 |
| 5,001,935 A | | 3/1991 | Tekkanat et al. | 73/799 |
| 5,062,979 A | * | 11/1991 | Scharf et al. | 252/49.3 |
| 5,115,047 A | | 5/1992 | Hashimoto et al. | 525/444 |
| 5,174,914 A | * | 12/1992 | Gutzmann | 252/34 |
| 5,238,718 A | | 8/1993 | Yano et al. | 428/35.7 |
| 5,334,322 A | | 8/1994 | Williams, Jr. | 508/579 |
| RE34,742 E | | 9/1994 | Maier et al. | 428/36.5 |
| 5,371,112 A | | 12/1994 | Sayre et al. | 521/48 |

(List continued on next page.)

FOREIGN PATENT DOCUMENTS

JP 57-3892 1/1982

OTHER PUBLICATIONS

"Encyclopedia Of Chemical Technology, Fourth Edition, Flavor Characterization to Fuel Cells", *John Wiley & Sons*, vol. 11, pp. 621–644 (Date Unknown).

Interflon "Fin Food Lube A1" Brochure, 20 pgs., (Date Unknown).

(List continued on next page.)

*Primary Examiner*—Ellen M. McAvoy
(74) *Attorney, Agent, or Firm*—Merchant & Gould P.C.

(57) ABSTRACT

We have found that a clear, stable microemulsion can be used during container transport operations during which the container is contacted with a transparent dispersion of hydrophilic and oleophilic materials. A process for lubricating a container, such as a beverage container, or a conveyor for containers, by applying to the container or conveyor, a thin continuous, substantially non-dripping layer of a transparent dispersed liquid lubricant. The process provides many advantages compared to the use of a conventional lubricant diluted with water.

69 Claims, 2 Drawing Sheets

U.S. PATENT DOCUMENTS

| | | | | | |
|---|---|---|---|---|---|
| 5,391,308 | A | | 2/1995 | Despo | 508/164 |
| 5,474,692 | A | * | 12/1995 | Laufenberg et al. | 252/34 |
| 5,509,965 | A | | 4/1996 | Harry et al. | 118/423 |
| 5,565,127 | A | | 10/1996 | Laufenberg et al. | 508/220 |
| 5,573,819 | A | | 11/1996 | Nugent, Jr. et al. | 428/34.8 |
| 5,652,034 | A | | 7/1997 | Seiner | 428/36.6 |
| 5,658,619 | A | | 8/1997 | Kirschner et al. | 427/512 |
| 5,663,131 | A | | 9/1997 | Winicov et al. | 508/580 |
| 5,681,628 | A | | 10/1997 | Niederst et al. | 428/35.7 |
| 5,698,269 | A | | 12/1997 | Carlblom et al. | 427/475 |
| 5,698,498 | A | | 12/1997 | Luciani et al. | 508/193 |
| 5,721,023 | A | | 2/1998 | Ostapchenko | 428/35.2 |
| 5,723,418 | A | * | 3/1998 | Person Hei et al. | 508/511 |
| 5,728,770 | A | | 3/1998 | Yamamoto et al. | 524/755 |
| 5,783,303 | A | | 7/1998 | Tsuei | 428/354 |
| 5,789,459 | A | | 8/1998 | Inagaki et al. | 522/16 |
| 5,876,812 | A | | 3/1999 | Frisk et al. | 428/35.7 |
| 5,925,601 | A | * | 7/1999 | McSherry et al. | 508/425 |
| 6,207,622 | B1 | * | 3/2001 | Li et al. | 508/208 |
| 6,214,777 | B1 | * | 4/2001 | Li et al. | 508/388 |

OTHER PUBLICATIONS

Interflon®, http://www.interflon.nl/engels.htm, last updated Jun. 18, 1999, pp. 1–10.

Du Pont Krytox® Brochure, "Krytox® Dry Film Lubricants", pp. 1–6 (Nov. 1997).

Synco Chemical Corporation, http://www.super–tube.com, last updated May 5, 1999, 5 pgs.

"Microemulsion: A Definition", http://surfactants.net/microemulsion.htm, last updated Nov. 23, 2000, 1 page.

Moskala, E., "Environmental Stress Cracking in PET Beverage Containers", pp. 8–1 – 8–15 (1996).

Moskala, E., "Environmental Stress Cracking in PET Carbonated Soft Drink Containers", pp. 51–70 (1998).

Tekkant, B. et al., "Environmental Stress Cracking Resistance of Blow Molded Poly(Ethylene Terephthalate) Containers", *Polymer Engineering and Science*, vol. 32, No. 6, pp. 393–394 (Mar. 1992).

* cited by examiner

STABLE DISPERSION OF LIQUID HYDROPHILIC AND OLEOPHILIC PHASES IN A CONVEYOR LUBRICANT

BACKGROUND OF THE INVENTION

In commercial container filling or packaging operations, containers are moved by a conveyor or a conveying system at high rates of speed, up to 1000 containers per minute or more. In current bottling operations, copious amounts of lubricant solutions in dilute aqueous form (usually based on ethoxylated amines or fatty acid amines) are typically applied to the conveyor or containers using spray, fountain or other pumping equipment. Some aqueous conveyor lubricants are not compatible with thermoplastic beverage containers made of polyethylene terephthalate (PET) and other plastics. Conventional lubricants typically require use of large amounts of diluent water on the conveying line, which must then be disposed of or recycled, causing a wet environment.

The containers are filled with foods, water, carbonated or non-carbonated beverage in a filling apparatus that involves a moving conveyor surface that transports the container during filling. The conveyor structure comprises a filling or packing station, a capping station and often ends at a station for labeling or final storage. Initially such conveyor systems were lubricated using large amounts of lubricant diluted with large amounts of water. Representative examples of such aqueous conveyor lubricant compositions applied to conveyors are found in Stanton et al., U.S. Pat. No. 4,274,973 and Stanton, U.S. Pat. No. 4,604,220. A series of allegedly stress crack inhibiting substantially soluble aqueous lubricants were introduced including Rossio et al., U.S. Pat. Nos. 4,929,375 and 5,073,280; and Wieder et al., U.S. Pat. No. 5,009,801. These patents assert that certain substituted aromatic compounds, certain couplers and saponifying agents and certain amine compounds can inhibit stress cracking in appropriately formulated materials.

In large part the compositions used in these conventional systems are either clear solutions or suspensions (macroemulsions) of sparingly soluble materials in water. Many conventional systems are clear solutions of neutralized fatty acids in an aqueous base or solutions of soluble ethoxylated amines in an aqueous medium. However, conventional silicone emulsions are either opaque or translucent depending on concentration. Conventional silicone emulsions are macroemulsions of sparingly soluble or insoluble materials dispersed in an aqueous medium.

A substantial need exists for improved methods lubricating common container materials in any environment. Lubricant composition should provide an acceptable level of lubricity for the system. The lubricant preferably has a viscosity which allows it to be applied by conventional pumping and/or application apparatus, such as by spraying, roll coating, wet bed coating, and the like, commonly used in the industry.

We have found that current methods of lubricating such containers are wasteful of the lubricant material since a substantial proportion of the materials is lost as it leaves the container surface. Further, substantial proportions of the lubricant remain on the container as a foam and are carried from the conveyor as the food packaging or beverage-bottling operations are continued. Many available lubricant materials that have sparingly soluble or insoluble lubricant materials in an aqueous medium can separate and form a separate phase which, under certain circumstances, can be incompatible with operating systems. Such materials can plug lines, pumps and nozzles. Further, such lubricant materials often are not preferred by operating personnel for use in lubricating lines because of their hazy, translucent appearance or lack of clarity.

BRIEF DESCRIPTION OF THE INVENTION

We have found that the properties of lubricants can be substantially improved if a substantially clear or transparent lubricant is formulated such that two separate, mutually insoluble hydrophilic and oleophilic phases are used in a formulation such that one phase is dispersed in another phase. The dispersion form is a thermodynamically stable composition. Preferred compositions are considered to be in the form of a microemulsion. The composition can be a oleophilic phase dispersed in a hydrophilic phase or a hydrophilic phase dispersed in an oleophilic phase. A preferred product format involves dispersing oleophilic materials into a hydrophilic phase. The oleophilic material can be common oils including natural oils, petroleum derived oils, silicone oils, or other oily or oleophilic material that can be dispersed in aqueous phase. The hydrophilic phase can comprise water, an aqueous solution or a water soluble, water miscible or aqueous compatible composition.

A microemulsion is a thermodynamically stable dispersion of one liquid phase in another phase, each phases being substantially insoluble in the other. An interfacial film of surfactant typically stabilizes a microemulsion. The microemulsion may be in the form of either an oil-in-water or water-in-oil composition. In oil-in-water forms, the oil is dispersed as very small droplets in continuous water or aqueous phase. In a water-in-oil microemulsion, water droplets are dispersed into an oil continuous phase. Microemulsions, different than a typical, opaque or translucent suspension, emulsion or macroemulsion, are typically clear compositions. The clarity of the solution results from the droplet size which is typically smaller than the smallest wavelength of a visible light radiation (about 350 nm). Since the particle size is smaller than light wavelengths, it is believed that the light is not scattered by the small droplets resulting in transparent solutions. The interfacial tension between the two phases are relatively low, adding to the thermodynamic stability of the microemulsion particles in the continuous phase. In substantial contrast to a microemulsion, a dispersion, emulsion (or macroemulsion) is an unstable suspension of droplets in a continuous phase. Such droplets will typically agglomerate, coalesce and, at some point, can separate from the continuous phase. In macroemulsions, the droplet sizes are much larger, typically 1 micron or more resulting in a cloudy or milky dispersion. The clear lubricants of the invention which we believe is a microemulsion may be applied to the conveyor without dilution or with a relatively modest dilution, e.g. at a water:lubricant ratio of less than 10:1 in a thin coating of lubricant formed by applying relatively small amounts of lubricant onto the moving container bearing surface of the conveyor. Alternatively, the microemulsion compositions of the invention can be diluted with water to form a dilution of the lubricant in water at a ratio of about 1:100 to about 1:500 parts of lubricant per parts of aqueous diluent and applied to conveyor surface. The continuous phase medium can comprise either an aqueous, hydrophilic or aqueous solution or composition or aqueous medium or a oleophilic, non-aqueous composition or oleophilic medium. Such materials can be applied in limited amounts directly onto a conveyor surface and can provide adequate lubricating properties at the container conveyor interface. Lubricants of the invention can comprise a transparent dispersion of an oleophilic, typically a silicone fluid, natural oil, a petroleum oil or other oleophilic materials in a hydrophilic phase such that the oil or oleophilic material has a reduced particle size of less than 300 nm, preferably less than 100 nm in the continuous hydrophilic phase. Alternatively, the dispersion can comprise small particles of a hydrophilic material dispersed in an oil phase. In such an embodiment, the hydrophilic phase can have a particle size of less than 300 nm., preferably less than 100 nm. as described above, most preferably about 1 to 80 nm. The clarity or cloudiness (turbidity) of the lubricant compositions can be measured by common spectrophotometers such as a Spectronic Genesys 5 spectrophotometer at a wavelength of about 400 nm. Other wavelengths can be used if the selected wavelength can measure the scattering of light representative of clear solutions. Other conventional particle size measuring methods can also be used. The mixtures are substantially clear with an absorption optically clear with absorption, in general, below 0.1 preferably below 0.05 measured at 400 nm. Here the absorption is defined as the fraction of incident light loss due to scattering. Other factors can impact the absorbance measured in the lubricant. Factors such as wavelength of light, the difference of refractive index between the medium and the scattering particulate, droplet or unit, the number of droplets per unit volume and the volume of the scattering units or droplet.

The invention can have a number of aspects. One aspect of the invention involves a method of use of a microemulsion lubricant of oleophilic liquid. The lubricant comprises, in a liquid aqueous medium, a dispersion of a oleophilic oil composition and optionally a lubricant additive composition. A further aspect of the invention involves contacting a conveyor and/or container with a liquid dispersion of a hydrophilic lubricant in a liquid hydrocarbon oil. In a third aspect the lubricants detailed above can be used simultaneously with a second lubricant composition.

Preferred oleophilic materials that can be used in such an environment, as the dispersed droplets in the oil-in-water emulsion or as a continuous oil phase, include oils including hydrocarbon oils, fatty oils, silicone oils, and other oleophilic oily or hydrocarbon lubricants from a variety of sources. One particularly useful form of the lubricant is the form of a silicone material that can be used in common lubricant compositions. Further, one particularly advantageous form of such lubricants is in the form of an aqueous dispersion of the silicone dispersion that is in a lubricant formulation.

In one preferred lubricant material of the invention, we have found that an effective lubricant can be made by combining a liquid diol, triol or polyol (either a liquid material or a solution of the material in an aqueous diluent) with an oleophilic material such as an oil, a silicone oil, a petroleum oil, a natural oil, dissolved or dispersed in an aqueous medium that can contain a variety of additional additive materials. We have found that close control of a weight ratio of diol, triol or polyol to water provides ability to control clarity and to obtain a transparent lubricant using commonly opaque or translucent silicone materials. For the purpose of this patent application, the term "opaque" means that substantially all light is either reflected or scattered by a liquid mass. The term "translucent" means that some light can pass through a liquid mass, a substantial proportion of the light being reflected or scattered. Lastly, the term "transparent" indicates that virtually all light passes without reflection, or scattering through a liquid mass and an observer can see through such a liquid mass under controlled conditions. A liquid may have an absorbance at a certain wavelength, but still be in a form that is visually clear. In such a clear solution, any absorbance would be a molecular absorbance. The absorbance measured in the methods of this invention relate to light scattered by the emulsion droplets of a size that efficiently scatters visible wavelengths. We have provided a means to measure the optical clarity of a liquid material using a spectrophotometric technique establishing an absorbance (the fraction of incident light loss due to scattering) that is representative of clarity or optical clarity elsewhere in the application.

For the purpose of this specification and claims, the term "coating" is intended to mean a continuous or discontinuous thin liquid layer of the lubricant dispersions of the invention on a moving conveyor surface. Such a coating can be formed by applying the liquid to the surface such that the surface of the conveyor is substantially completed covered with the lubricant. Alternatively, the term "coating" can also connote the timed application of the lubricant such that the lubricant can be applied intermittently to a surface of a moving conveyor. The intermittent application of the lubricant can still provide an adequate lubricating layer on the surface. For the lubricant to work successfully, there must be an amount of lubricant at the container conveyor interface to obtain reduced coefficient of friction. In other words, a successful lubricant coating is present when the lubricant is present at the interface to successfully reduce friction during conveying of a container from place to place on a conveyor.

A still more preferred lubricant system of the invention involves a lubricant comprising a substantial proportion of glycerin or glycerol and a minor proportion of a silicone oil dispersed in an aqueous phase that can contain emulsion stabilizing materials derived from the silicone material or added separately in the preparation of the lubricant material. The microemulsion lubricant can have a dispersed phase that can be made from a dispersion with an initial particle size that can range from about 0.3 to about 2 microns. Surprisingly, combining an opaque silicone dispersion with an initial particle size of about 0.3 to 2 microns in the lubricants of the invention can produce a clear composition with particle size of less than 300 nm thus obtaining and maintaining clarity. Major influences of the silicone emulsion component in the stability and clarity of the clear lubricant composition or microemulsion include silicone oil structure, the molecular weight of the silicone, the type of the emulsifier, emulsion concentration and particle size.

We have found that one important characteristic for maintaining a stable clear microemulsion relates to the glycerin to water ratio. We have found that for the glycerin/water/silicone microemulsion system that the glycerin and water ratio to produce and maintain a clear, transparent lubricant comprises about 2 parts per weight glycerin per each 1 part by weight of water to as little as 1 part of glycerin per each 1 part of water in the total emulsion composition.

At a certain ratio of glycerin to water, we are able to obtain a transparent beverage lubricant with ingredient(s) of silicone emulsion(s) such as:

Glycerin:Water (wt:wt ratio)=1.2 to 1.6 for Lambert silicone emulsion E2175 (60% dimethylsiloxane)

Glycerin/Water (wt:wt ratio)=1.2 to 1.6 for Lambert silicone emulsion E2140FG (35% dimethylsiloxane)

We have found that by forming microemulsion materials, the undesirable creaming or phase separation of many emulsion or macroemulsion compositions can be avoided or significantly reduced. Phase separation is undesirable in the appearance of the product and depending on the formulation can cause nozzle plugging in equipment used to manufacture and dilute the lubricants and apply the lubricants to conveyors. Lubricants have reduced viscosity in comparison to some macro emulsions that is helpful in certain applications where the materials need to be pumped through lines on small orifices. Further, we believe that microemulsions are easier to clean and can be removed with water rinses or simple surfactant cleaning practices.

The compositions of the invention can be used for lubricating food and beverage containers on many conveyor surfaces. Conveyor surfaces can include thermoplastic or thermoset polymer materials, composite, metallic or multi-component surfaces. Containers include coated cellulosic carton, paper carton, plastic, metal and glass containers. One aspect of the invention involves thin coating lubrication of conveyor systems used in food packaging and beverage bottling and can be obtained using a continuous or discontinuous thin coating of a stable dispersion or microemulsion lubricant layer formed on a conveyor surface. The lubricant layer is maintained at a thickness of less than about 3 millimeters, preferably about 0.0001 to 2 mm, with an add on of lubricant on the surface of less than about 0.05 gms-in$^{-2}$, preferably about $5\times10^{-4}$ to 0.035 gms-in$^{-2}$, most preferably about $2\times10^{-4}$ to 0.025 gms-in $^{-2}$. Such a thin lubricating coating of the dispersed or microemulsion lubricant on the conveyor provides adequate lubrication to the conveyor system but ensures that the lubricant cannot generate high foam, does not flow from the conveyor surface and contacts the absolute minimum surface area of the food container such as the beverage bottle as possible. The form of the microemulsion can be either water-in-oil or oil-in-water methods of the invention can be used to convey virtually any food container on a conveyor line, but is particularly adapted to transporting carton container, glass bottles, steel and aluminum cans and thermoplastic beverage containers such as polycarbonate, high density and low density polyethylene, polyethylene terephthalate (PET) beverage containers. Common PET beverage containers are formed with a base cup or with a complex curvature in the base including the "champagn" base, the petaloid base having a five lobed structure in the base or other shapes that provide stability to the bottle when it is placed on a surface. The contact with the lubricant on the pentaloid base must be minimized.

We have found that using a thin coating of the dispersed or microemulsion lubricant, that less than about 100 to 3000 mm$^2$, preferably 100 to 2000 mm$^2$ of the surface of the bottle is contacted with lubricant. Certainly, the height of the lubricant in contact with the bottle is less than 3 millimeters. The motion of the conveyor, the tendency of the bottles to rock or move while being conveyed and the other aspects of relative movement at the bottle conveyor interface affect the height of the lubricant on the bottle. The methods of this invention are primarily directed to conveyor operations and do not involve any change in shape of the container arising from forming operations. The desirable coefficient of friction of the conveyor lubricant is less than about 0.14, preferable less than about 0.1.

Another aspect of the invention provides a method for lubricating the passage of a container along a conveyor comprising applying a mixture of a dispersed or emulsified silicone material and a water-miscible lubricant to at least a portion of the container-contacting surface of the conveyor or to at least a portion of the conveyor-contacting surface of the container. The present invention provides, in another aspect, a lubricated conveyor or container, having a lubricant coating on a container-contacting surface of the conveyor or on a conveyor-contacting surface of the container, wherein the coating comprises a mixture of a water-miscible silicone material and a water-miscible lubricant. The invention also provides conveyor lubricant compositions comprising a mixture of a water-miscible silicone material and a water-miscible lubricant. During some packaging operations such as beverage container filling, the containers are sprayed with warm water in order to warm the filled containers and discourage condensation on the containers downstream from the filling station. This warm water spray can dilute the conveyor lubricant and reduce its lubricity.

The compositions used in the invention can be applied in relatively low amounts and can be formulated such that the lubricants do not require in-line dilution with significant amounts of water. The compositions of the invention provide thin, substantially non-dripping lubricating coatings. In contrast to lubricants diluted with large amounts of water, the lubricants of the invention provide drier lubrication of the conveyors and containers, drier conveyor line and working area, and reduced lubricant usage, thereby reducing waste, cleanup and disposal problems.

In another aspect of the invention, the lubricants of the invention can also be used in a conventional dilute system. The lubricant microemulsions are contacted with aqueous diluents at a ratio of about 1 part of lubricant by volume per each 100 to 500 parts of diluent. The resulting aqueous lubricant is carefully applied to a conveyor container interface to lubricate filling operations.

DETAILED DESCRIPTION OF THE PREFERRED EMBODIMENTS

Figure 1:
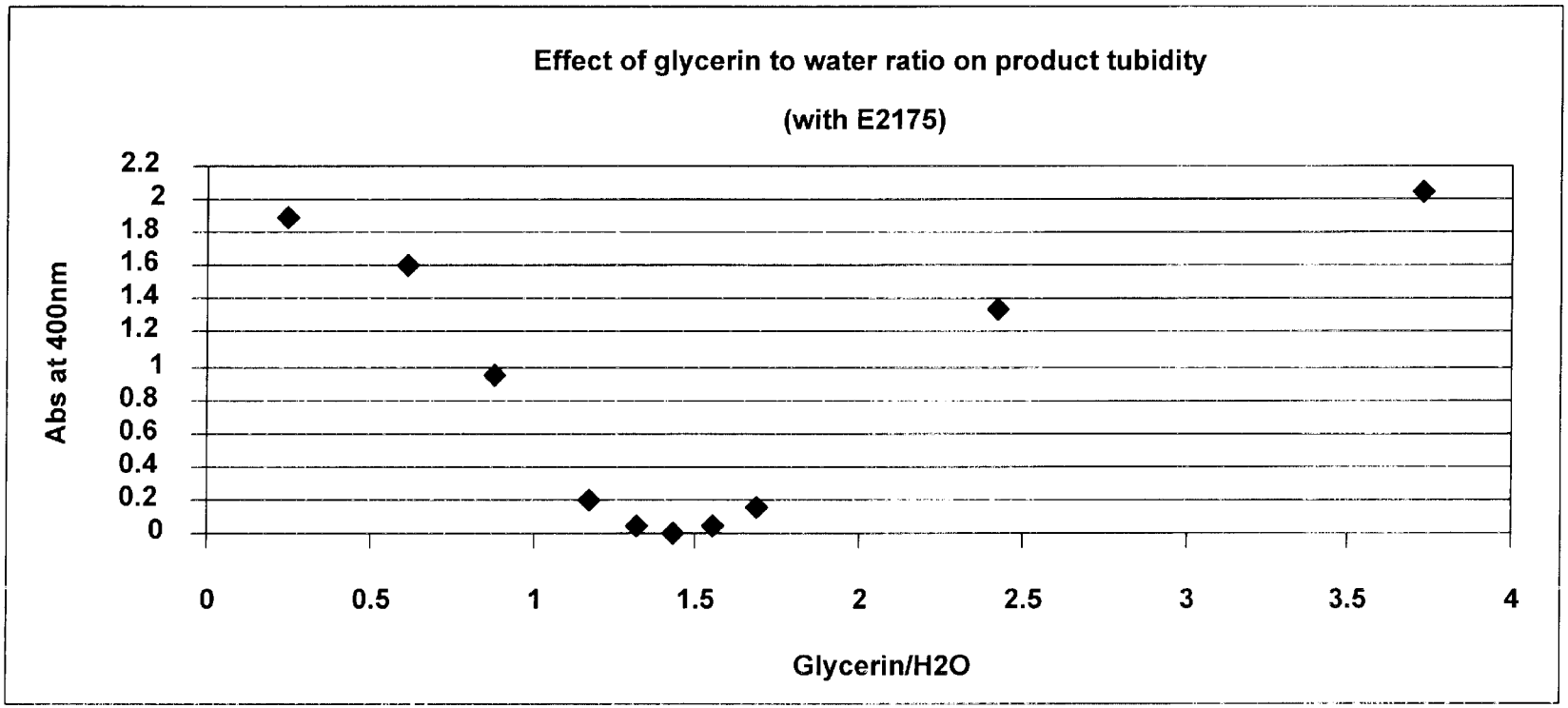
FIG. 1 is a graphical representation of the clarity of the lubricant material using a first silicone emulsion as a function of the concentration of water and glycerin.

The present invention uses a thin, substantially non-dripping layer of a stable dispersed or micro emulsion lubricant to lubricate containers and conveyor systems upon which the containers travel in a thin coating or conventional dilute aqueous form. By "substantially non-dripping", we mean that the majority of the lubricant remains on the container or conveyor following application until such time as the lubricant may be deliberately removed away. A "Thin Coating" application uses a small amount of lubricant in a thin layer without dilution, while a "conventional dilute aqueous material" is diluted and applied to a conveyor container interface in relatively larger amounts than in thin coating applications. The invention provides a lubricant coating that reduces the coefficient of friction of coated conveyor parts and containers and thereby facilitates movement of containers along a conveyor line. The lubricant compositions used in the invention can optionally contain water or a suitable diluent, as a component or components in the lubricant composition as sold or added just prior to use. The thin coating lubricant composition does not require in-line dilution with significant amounts of water, that is, it can be applied undiluted or with relatively modest dilution, e.g., at a water:lubricant weight ratio of less than about to 10 parts of diluent per each 1 part of lubricant. In contrast, conventional lubricants diluted with water are applied using dilution ratios of about 100:1 to 500:1 diluent to lubricant ratio. The lubricant compositions preferably provide a renewable coating that can be reapplied, if desired, to offset the effects of coating wear. They preferably can be applied while the conveyor is at rest or while it is moving, e.g., at the conveyor's normal operating speed. The lubricant coating preferably is substantially non-dripping, that is, preferably the majority of the lubricant remains on the container or conveyor following application until such time as the lubricant may be deliberately removed away.

The lubricant composition resists loss of lubricating properties in the presence of water or hydrophilic fluids, but can readily be removed from the container or conveyor using conventional aqueous cleaners, without the need for high pressure, mechanical abrasion or the use of aggressive cleaning chemicals. The lubricant composition can provide improved compatibility with plastic conveyor parts and plastic bottles. A variety of materials can be employed to prepare the stable dispersion or microemulsion lubricant used with lubricated containers and conveyors of the invention, and to carry out the processes of the invention. These materials can be a single phased hydrophilic or oleophilic lubricant, or two or multi phase lubricant. These lubricant materials can be presented in the lubricant compositions of the invention as the oil or the aqueous/hydrophilic liquid. The oleophilic lubricant can contain various natural, non-aqueous, oleophilic, lubricants, petroleum lubricants, synthetic oils and greases. Examples of natural lubricants include vegetable oils, fatty oils, animal fats, and others that are obtained from seeds, plants, fruits, and animal tissue. Examples of petroleum lubricants include mineral oils with various viscosities, petroleum distillates, and petroleum products.

Examples of synthetic oleophilic materials include synthetic hydrocarbons, silicones such as silicone oil and silicone surfactants, fluoro-containing compounds such as perfluoroalkylpolyethers (PFPE), chlorotrifluoroethylene, and fluorosurfactants, organic esters, high molecular weight alcohols, carboxylic acids, phosphate esters, polyphenyl ethers, non-water soluble poly(alkylene glycol)s such as polypropylene glycols, oxypolypropylene glycols, and the like.

Examples of useful solid lubricants include molybdenum disulfide, boron nitride, graphite, silica particles, silicone gums and particles, polytetrafluoroethylene (PTFE, Teflon), fluoroethylene-propylene copolymers (FEP), perfluoroalkoxy resins (PFA), ethylene-chloro-trifluoroethylene alternating copolymers (ECTFE), poly (vinylidene fluoride) (PVDF), and the like. The lubricant composition can contain an effective amount of a water-based cleaning agent-removable solid lubricant based on the weight of the lubricant composition. The lubricant composition can also contain a solid lubricant as a suspension in a substantially non-aqueous liquid. In such a situation, the amount of solid lubricant can be about 0.01 to 70 weight percent, preferably 0.05 to 50 percent by weight, based on the weight of the composition.

Specific examples of useful lubricants include oleic acid, corn oil, mineral oils available from Vulcan Oil and Chemical Products sold under the "Bacchus" trademark; fluorinated oils and fluorinated greases, available under the trademark "Krytox" from is DuPont Chemicals. Fluorosurfactants available under the trademark "Zonyl" from DuPont Chemicals. Also useful are siloxane fluids available from General Electric silicones, such as SF96-5 and SF 1147 and synthetic oils and their mixture with PTFE available under the trademark "Super Lube" from Synco Chemical. Also, high performance PTFE lubricant products from Shamrock, such as nano FLON M020™, FluoroSLIP™ 225 and Neptune™ 5031. Silicone emulsions are often stabilized using a surfactant material that can maintain the appropriate interfacial tension and particle size of the dispersion. Typical surfactants are nonionic cationic and anionic surfactants and are conventional the preparation of the silicone dispersion materials. Common available commercial silicone oil dispersions are typically creamy or at best translucent liquid compositions.

A variety of dispersed silicone materials can be employed in the lubricant compositions, including silicone emulsions (such as emulsions formed from methyl(dimethyl), higher alkyl and aryl silicones; functionalized silicones such as chlorosilanes; amino-, methoxy-, epoxy- and vinyl-substituted siloxanes; and silanols). Suitable silicone emulsions include E2175 high viscosity polydimethylsiloxane (a 60% siloxane emulsion commercially available from Lambent Technologies, Inc.), E2140-FG food grade intermediate viscosity polydimethylsiloxane (a 35% siloxane emulsion commercially available from Lambent Technologies, Inc.), HV490 high molecular weight hydroxy-terminated dimethyl silicone (an anionic 30–60% siloxane emulsion commercially available from Dow Coming Corporation), SM2135 polydimethylsiloxane (a nonionic 50% siloxane emulsion commercially available from GE Silicones) and SM2167 polydimethylsiloxane (a cationic 50% siloxane emulsion commercially available from GE Silicones. Other water-miscible silicone materials include finely divided silicone powders such as the TOSPEARL™ series (commercially available from Toshiba Silicone Co. Ltd.); and silicone surfactants such as SWP30 anionic silicone surfactant, WAXWS-P nonionic silicone surfactant, QUATQ-400M cationic silicone surfactant and 703 specialty silicone surfactant (all commercially available from Lambent Technologies, Inc.). Preferred silicone emulsions typically contain from about 20 wt. % to about 80 wt. % water. Certain silicone materials (e.g., non-water-soluble silicone fluids and non-water-dispersible silicone powders) can also be employed in the lubricant if combined with a suitable emulsifier (e.g., nonionic, anionic or cationic emulsifiers). For applications involving plastic containers (e.g., PET beverage bottles), care should be taken to avoid the use of emulsifiers or other surfactants that promote environmental stress cracking in plastic containers. Poly- dimethylsiloxane emulsions are preferred silicone materials. Preferably the lubricant composition is substantially free of surfactants aside from those that may be incorporated in the materials provided from the supplier. These surfactant materials are required to emulsify the silicone compound sufficiently to form the silicone emulsion products used to form the final microemulsion lubricant formulation.

A variety of hydrophilic lubricating materials can be employed in the lubricant compositions, or otherwise as disclosed herein, including hydroxy-containing compounds such as polyols (e.g., glycerol, glycerin, sorbitol, glucose, arabital, and propylene glycol); polyalkylene glycols (e.g., the CARBOWAX™ series of polyethylene glycols, and methoxypolyethylene glycols, commercially available from Union Carbide Corp.); linear copolymers of ethylene and propylene oxides (e.g., UCON™ 50- HB-100 water-soluble ethylene oxide and propylene oxide copolymer, commercially available from Union Carbide Corp.); and sorbitan esters (e.g., TWEEN™ series 20, 40, 60, 80 and 85 polyoxyethylene sorbitan esters and SPAN™ series 20, 80, 83 and 85 sorbitan esters, commercially available from ICI Surfactants). Other suitable hydrophilic lubricating materials include phosphate esters, amines and their derivatives, and other commercially available hydrophilic lubricating materials that will be familiar to those skilled in the art, and mixtures thereof. Derivatives (e.g., partial esters or ethoxylates) of the above hydrophilic lubricating materials can also be employed. For applications involving plastic containers, care should be taken to avoid the use of hydrophilic lubricating materials that might promote environmental stress cracking in plastic containers. Preferably the hydrophilic lubricating material is a polyol such as glycerol or glycerin, whose specific gravity is 1.25 for a 96 wt. % solution of glycerol in water. The hydrophilic phase can contain a proportion of water obtained from the materials used in the composition or through blending the lubricant with suitable water such as deionized or softened water.

The aqueous liquid lubricant compositions of the invention can include a miscible cosolvent. Preferred miscible cosolvents include alcohols including methanol, ethanol, n-propanol, isopropanol, n-butanol, tertiary butanol, pentanol, isopentanol, neopentanol, hexanol, 3-ethylbutanol, and other $C_{3-8}$ alcohols of various position isomers and mixtures thereof. Further, miscible and liquid diols and triols can be used including ethylene glycol, propylene glycol, glycerin (glycerol), butylene glycol, methyl ethers thereof, oligomers thereof, etc.

Preferred amounts for the silicone material, hydrophilic lubricant and optional water or hydrophilic diluent are about 0.05 to about 20 wt. % of the silicone material (exclusive of any water or other hydrophilic diluent that may be present if the silicone material is, for example, a silicone emulsion), about 10 to about 99.95 wt. % of the hydrophilic lubricant, and 0 to about 89.95 wt. % of water or hydrophilic diluent. More preferably, the lubricant composition contains about 0.1 to about 8 wt. % of the silicone material, about 20 to about 90 wt. % of the hydrophilic lubricant, and about 2 to about 79.9 wt. % of water or hydrophilic diluent. Most preferably, the lubricant composition contains about 0.2 to about 4 wt. % of the silicone material, about 30 to about 75 wt. % of the hydrophilic lubricant, and about 21 to about 69.8 wt. % of water or hydrophilic diluent.

The silicone lubricants are water-dispersible in a cleaning mode and can be easily removed from the container and/or conveyor, if desired, with water or an aqueous cleaner. If water is employed in the lubricant compositions, preferably it is deionized water. Other suitable hydrophilic diluents include alcohols such as isopropyl alcohol. For applications involving plastic containers, care should be taken to avoid the use of water or hydrophilic diluents containing substances that might promote environmental stress cracking in plastic containers.

A multistep process of lubricating can be used. For example, one stage of treating the container and/or conveyor with a stable dispersed or microemulsion lubricant and another stage of treating with a similar or different type of lubricant, such as a substantially non-aqueous lubricant or an aqueous lubricant can be used. This is not limited to any specific order. Any desired substantially non-aqueous lubricant can be used in the first or second stage. In addition to the lubricant, other components can be included with the lubricant to provide desired properties. For example, antimicrobial agents, colorants, foam inhibitors or foam generators, PET stress cracking inhibitors, viscosity modifiers, friction modifiers, antiwear agents, oxidation inhibitors, rust inhibitors, extreme pressure agents, detergents, dispersants, materials and/or surfactants can be used, each in amounts effective to provide the desired results. Examples of useful antiwear agents and extreme pressure agents include zinc dialkyl dithiophosphates, tricresyl phosphate, and alkyl and aryl disulfides and polysulfides. The antiwear and/or extreme pressure agents are used in amounts to give desired results. This amount can be from 0 to about 20 weight percent, preferably about 1 to about 5 weight percent for the individual agents, based on the total weight of the composition. Examples of useful detergents and dispersants include alkylbenzenesulfonic acid, alkylphenols, carboxylic acids, alkylphosphonic acids and their calcium, sodium and magnesium salts, polybutenylsuccinic acid derivatives, silicone surfactants, fluorosurfactants, and molecules containing polar groups attached to an oil-solubilizing aliphatic hydrocarbon chain. The detergent and/or dispersants are used in an amount to give desired results. This amount can range from 0 to about 30, preferably about 0.5 to about 20 percent by weight for the individual component, based on the total weight of the composition. Useful antimicrobial agents include disinfectants, antiseptics and preservatives. Non-limiting examples of useful antimicrobial agents include phenols including halo- and nitrophenols and substituted bisphenols such as 4-hexylresorcinol, 2-benzyl-4-chlorophenol and 2,4,4'-trichloro-2'-hydroxydiphenyl ether, organic and inorganic acids and its esters and salts such as dehydroacetic acid, peroxycarboxylic acids, peroxyacetic acid, methyl p-hydroxy benzoic acid, cationic agents such as quaternary ammonium compound, aldehydes such as glutaraldehyde, antimicrobial dyes such as is acridines, triphenylmethane dyes and quinones and halogens including iodine and chlorine compounds. The antimicrobial agents can be used in an amount sufficient to provide desired antimicrobial properties. For example, from 0 to about 20 weight percent, preferably about 0.5 to about 10 weight percent of antimicrobial agent, based on the total weight of the composition can be used. Examples of useful foam inhibitors include methyl silicone polymers. Non-limiting examples of useful foam generators include surfactants such as non-ionic, anionic, cationic and amphoteric compounds. These components can be used in amounts to give the desired results.

By container is meant any receptacle in which material is or will be held or carried. For example, beverage or food containers are commonly used containers. Beverages include any liquid suitable for drinking, for example, fruit juices, soft drinks, water, milk, wine, artificially sweetened drinks, sports drinks, and the like. The lubricant should generally be non-toxic and biologically acceptable, especially when used with food or beverage containers.

The present invention is advantageous as compared to prior (silicone emulsion) aqueous lubricants. The lubricants are clear and easy to handle and dilute if needed. The clear lubricants are phase stable. Active materials do not substantially separate preventing nozzle plugging and poor product appearance. In a thin coating lubrication mode, the substantially no in-line water dilution lubricants have reduced water content, good compatibility with PET, superior lubricity, low cost because large amounts of water are not used, and allow for the use of a drier working environment. Moreover, the present invention reduces the amount of microbial contamination in the working environment, because microbes generally grow much faster in aqueous environments, such as those from commonly used aqueous lubricants.

The lubricant can be applied to a conveyor system surface that comes into contact with containers, the container surface that needs lubricity, or both. The surface of the conveyor that supports the containers may comprise fabric, metal, plastic, elastomer, composites, or mixture of these materials. Any type of conveyor system used in the container field can be treated according to the present invention.

Similarly, only portions of the conveyor that contacts the containers need to be treated. The lubricant can be a permanent coating that remains on the containers throughout its useful life, or a semi-permanent coating that is not present on the final container.

The lubricant compositions preferably have a coefficient of friction (COF) that is less than about 0.14, more preferably less than about 0.1, when evaluated using the Short Track Conveyor Test described below. A variety of kinds of conveyors and conveyor parts can be coated with the lubricant composition. Parts of the conveyor that support or guide or move the containers and thus are preferably coated with the lubricant composition include belts, chains, gates, chutes, sensors, and ramps having surfaces made of fabrics, metals, plastics, composites, or combinations of these materials.

The lubricant composition can be a liquid at the time of application. Preferably the lubricant composition is a liquid having a viscosity that will permit it to be pumped and readily applied to a conveyor or containers, and that will facilitate rapid film formation whether or not the conveyor is in motion. The lubricant composition can be formulated so that it exhibits shear thinning or other pseudo-plastic behavior, manifested by a higher viscosity (e.g., non-dripping behavior) when at rest, and a much lower viscosity when subjected to shear stresses such as those provided by container movement or pumping, spraying or brushing the lubricant composition. This behavior can be brought about by, for example, including appropriate types and amounts of thixotropic fillers (e.g., treated or untreated fumed silicas) or other rheology modifiers in the lubricant composition. The lubricant coating can be applied in a constant or intermittent fashion. Preferably, the lubricant coating is applied in an intermittent fashion in order to minimize the amount of applied lubricant composition. For example, the lubricant composition can be applied for a period of time during which at least one complete revolution of the conveyor takes place. Application of the lubricant composition can then be halted for a period of time (e.g., minutes or hours) and then resumed for a further period of time (e.g., one or more further conveyor revolutions). The lubricant coating should be sufficiently thick to provide the desired degree of lubrication, and sufficiently thin to permit economical operation and to discourage drip formation. The lubricant coating thickness preferably is maintained at at least about 0.0001 mm, more preferably about 0.001 to about 2 mm, and most preferably about 0.005 to about 0.5 mm.

The lubricant can be used to treat any type of container, including those mentioned in the Background section of this application. For example, glass or plastic containers, including polyethylene terephthalate containers, polymer laminates, and metal containers, such as aluminum cans, papers, treated papers, coated papers, polymer laminates, ceramics, and composites can be treated.

The following Examples of formulations exemplify the inventive concepts and provide a best mode.

EXAMPLE 1–3

| | Glycerin (96%) Wt-% | Deionized $H_2O$ Wt-% | E2175 (60%) Wt-% | Glycerin to $H_2O$ Ratio | UV absorbance at 400 nm | Visual Appearance |
|---|---|---|---|---|---|---|
| Example 1 | 56.51 | 41.52 | 1.97 | 1.361 | 0.007 | Clear |
| Example 2 | 56.76 | 41.74 | 1.50 | 1.360 | 0.005 | Clear |
| Example 3 | 57.07 | 41.93 | 1.00 | 1.361 | 0.002 | Clear |

The above examples showed that a clear version of the lubricant was obtained from a cloudy silicone emulsion with an initial particle size of about 0.65 to 0.93 micron while the ratio of glycerin to water was about 1.36.

EXAMPLE 4–13

| Example | Glycerin (96%) Wt-% | Silicone Emulsion E2175 (60%) Wt-% | $H_2O$ Wt-% | Glycerin/$H_2O$ Ratio | UV absorbance at 400 nm | Visual Appearance |
|---|---|---|---|---|---|---|
| 4 | 77.24 | 2.05 | 20.71 | 3.730 | 2.0466 | Cloudy |
| 5 | 69.52 | 1.85 | 28.64 | 2.427 | 1.3354 | Cloudy |
| 6 | 61.79 | 1.64 | 36.57 | 1.690 | 0.1562 | Cloudy |
| 7 | 59.86 | 1.59 | 38.55 | 1.553 | 0.0416 | Clear |
| 8 | 57.93 | 1.54 | 40.53 | 1.429 | 0.0066 | Clear |
| 9 | 56.00 | 1.49 | 42.51 | 1.317 | 0.0406 | Clear |
| 10 | 53.30 | 1.41 | 45.29 | 1.177 | 0.1972 | Cloudy |
| 11 | 46.34 | 1.23 | 52.43 | 0.884 | 0.9448 | Cloudy |
| 12 | 37.54 | 1.00 | 61.47 | 0.611 | 1.6072 | Cloudy |
| 13 | 19.31 | 0.51 | 80.18 | 0.241 | 1.9008 | Cloudy |

The examples showed that at the glycerin to water ratio of 1.32 to 1.55, the lubricants containing silicone emulsion, E2175, initially a cloudy emulsion with a particle size of 0.65 to 0.93 micron, became clear liquid microemulsion. The clarity of the material as a function of water and glycerin is shown in FIG. 1.

EXAMPLE 14–23

| Example | Glycerin (96%) Wt-% | Silicone Emulsion E2140FG (35%) Wt-% | $H_2O$ Wt-% | Glycerin/$H_2O$ | UV absorbance at 400 nm | Visual Appearance |
|---|---|---|---|---|---|---|
| 15 | 77.24 | 2.05 | 20.71 | 3.730 | 1.158 | Cloudy |
| 16 | 69.52 | 1.85 | 28.64 | 2.427 | 0.268 | Cloudy |
| 17 | 61.79 | 1.64 | 36.57 | 1.690 | 0.037 | Slight Cloudy |
| 18 | 59.86 | 1.59 | 38.55 | 1.553 | 0.006 | Clear |
| 19 | 57.93 | 1.54 | 40.53 | 1.429 | 0.004 | Clear |
| 20 | 56.00 | 1.49 | 42.51 | 1.317 | 0.014 | Clear |
| 21 | 53.30 | 1.41 | 45.29 | 1.177 | 0.038 | Clear |
| 22 | 46.34 | 1.23 | 52.43 | 0.884 | 0.241 | Cloudy Blue |
| 23 | 30.90 | 0.82 | 68.28 | 0.452 | 0.757 | Cloudy |
| 24 | 15.45 | 0.41 | 84.14 | 0.184 | 0.854 | Cloudy |

Figure 2:
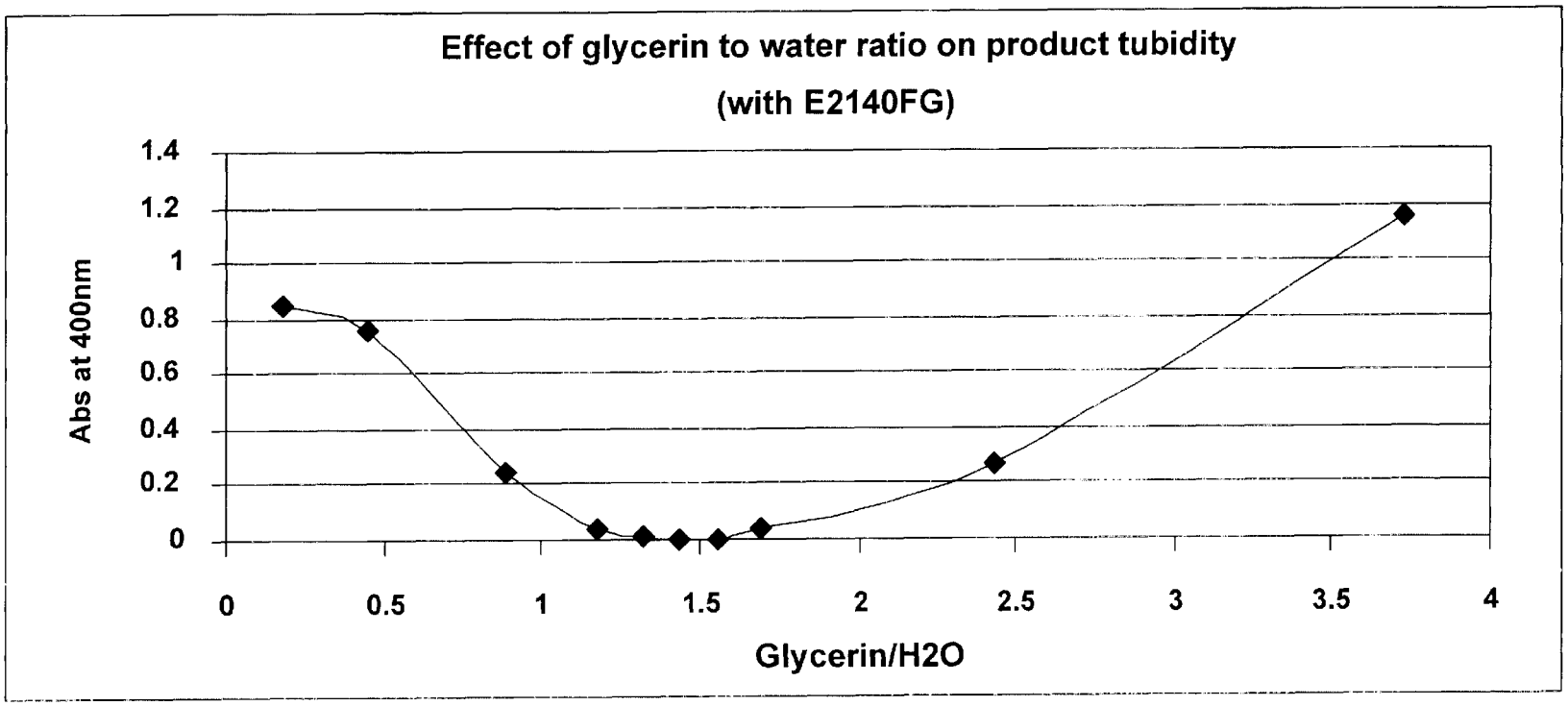
FIG. 2 is a graphical representation of the clarity of the lubricant material using a second silicone emulsion as a function of the concentration of water and glycerin.

The above examples showed that at the glycerin to water ratio of 1.18 to 1.55, the lubricant containing an initially opaque silicone emulsion, E2140FG, became a clear microemulsion liquid. The clarity of the material as a function of water and glycerin ratio is shown in FIG. 2.

Example: COF measurement with Short track test

| | | |
|---|---|---|
| Formula: | Glycerin (96%) | 57.93 g |
| | Lambent E2175 (60%) | 1.54 g |
| | DI water | 40.53 g |

Result: COF=0.79 for PET Bottle on Plastic Surface Lubrication

The example showed that the clear lubricant had an adequate lubricity. In general, COF measured for current commercially available aqueous lubricant is about 0.1 to 0.14.

Coefficient of friction (COF) was measured on a short track conveyor system: The determination of lubricity of the lubricant was measured on a short track conveyor system. The conveyor was equipped with two belts from Rexnord. The belt was Rexnord LF (polyacetal) thermoplastic belt of 3.25" width and 20 ft long. 10 to 20ml of the lubricant was applied to the conveyor surface evenly with a bottle wash brush. The conveyor system was run at a speed of 60–100 ft/min. Six 2L PET bottles filled with beverage were stacked in a rack on the track with a total weight of 16.15 kg. The rack was connected to a strain gauge by a wire. As the belts moved, force was exerted on the strain gauge by the pulling action of the rack on the wire. A computer recorded the pull strength. The coefficient of friction (COF) was calculated on the basis of the measured force and the mass of the bottles and it was averaged from the beginning to the end of the run.

EXAMPLE 24–25

| | Example 24 | Comparison 24 | Example 25 | Comparison 25 |
|---|---|---|---|---|
| Mixture Appearance | clear | cloudy | clear | cloudy |
| glycerin (96% active) % wt | 57.93 | 77.64 | 57.93 | 77.24 |
| $H_2O$ % wt | 40.53 | 20.82 | 39.44 | 19.25 |
| E2175 (60% active) % wt | 1.54 | 1.54 | | |
| E2140 FG (35% active) % wt | | | 2.63 | 3.51 |
| Glycerin:$H_2O$ | 1.43 | 3.73 | 1.47 | 4.01 |

Examples 24 and 25 showed that, with a proper ratio of glycerin to water, a cloudy lubricant containing opaque silicone emulsion, E2140FG or E2175, was converted to a clear liquid.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A moving conveyor or container lubricant composition comprising a stable dispersion of a first liquid phase and a second liquid phase resulting in a dispersion of the first phase as droplets in a continuous second liquid phase, the resulting dispersion being transparent.

2. The lubricant of claim 1 wherein the particle size of the dispersed particles in the dispersion is less than 300 nm.

3. The lubricant of claim 1 wherein the first liquid phase comprises an oleophilic liquid and the second liquid phase comprises an aqueous medium.

4. The lubricant of claim 1 wherein the second liquid phase comprises an aqueous soluble material or an aqueous solution and the first liquid phase comprises an oleophilic liquid.

5. The lubricant of claim 4 wherein the oleophilic liquid comprises a dispersion of the oleophilic liquid in an aqueous phase.

6. The lubricant of claim 5 wherein the oleophilic liquid comprises a petroleum oil or a natural oil.

7. The lubricant of claim 5 wherein the oleophilic material comprises a dispersion of a silicone composition in an aqueous medium.

8. The lubricant of claim 7 wherein the dispersion of a silicone composition in an aqueous medium comprises a silicone emulsion.

9. The lubricant of claim 7 wherein the mixture comprises about 0.05 to about 20 wt % of a silicone material.

10. The lubricant of claim 9 wherein the silicone composition comprises a finely divided silicone powder, a silicone fluid, a silicone surfactant, a silicone oil or mixtures thereof.

11. The lubricant of claim 7 wherein the aqueous soluble material or an aqueous solution comprises a water soluble lubricant comprising a hydroxy-containing compound selected from the group consisting of polyalcohols, such as alkane diols and alkane triols, their ester and ether derivatives, a polyalkylene glycol, a copolymer of ethylene and propylene oxide, a sorbitan ester or mixtures thereof.

12. The lubricant of claim 11 wherein the polyalcohols comprise glycerol, glycerin, or mixtures thereof.

13. The lubricant of claim 11 wherein the polyalcohols comprise propylene glycol, butylene glycol, or mixtures thereof.

14. The lubricant of claim 4 wherein the lubricant additionally comprises a cosurfactant.

15. The lubricant of claim 14 wherein the lubricant additionally comprises a solvent.

16. The lubricant of claim 15 wherein the solvent comprises a $C_{1-6}$ lower alcohol.

17. The lubricant of claim 7 wherein the silicone comprises a polydimethylsiloxane, a polyalkylsiloxane, a polyphenylsiloxane a derivative thereof or mixtures thereof.

18. The lubricant of claim 1 wherein the particle size of the dispersed particles is less than about 80 nm.

19. The lubricant of claim 1 wherein the absorbance of the lubricant is less than about 0.1 at a wavelength of 400 nm using an analytical spectrophotometer.

20. The lubricant of claim 1 wherein the particle size of the dispersed particles is less than about 10 nm.

21. A moving conveyor or container lubricant composition comprising a stable dispersion of a oleophilic liquid phase in a hydrophilic liquid phase resulting in a dispersion of a first phase as droplets in a continuous second liquid phase, the resulting dispersion being transparent.

22. The lubricant of claim 21 wherein the particle size of the dispersed particles is less than 300 nm.

23. The lubricant of claim 21 wherein the hydrophilic phase comprises an aqueous phase.

24. The lubricant of claim 23 wherein the aqueous phase comprises a solution comprising glycerin and water.

25. The lubricant of claim 24 wherein there is about 1 to 2 parts of glycerin for each 1 part of water.

26. The lubricant of claim 24 wherein the oleophilic phase comprises an oil selected from the group consisting of a petroleum oil, a natural fatty oil, a silicone oil or mixtures thereof.

27. The lubricant of claim 26 wherein the lubricant composition comprises about 0.05 to 5 wt % of the oleophilic liquid phase.

28. A moving conveyor or container lubricant composition comprising a stable dispersion comprising a hydrophilic phase comprising a major proportion of glycerin, about 25 to about 49 wt % of water and an oleophilic phase comprising about 0.05 to 20 wt % of a silicone oil dispersed in the glycerin and water phase, wherein the weight ratio between glycerin water comprises about 1 to about 2 parts of glycerin per each part of water, the resulting dispersion being substantially transparent.

29. The lubricant of claim 28 wherein the particle size of the dispersed phase is less than 300 nm.

30. The lubricant of claim 28 wherein the absorbance of the lubricant is less than about 0.1 at a wavelength of 400 nm using an analytical spectrophotometer.

31. The lubricant of claim 29 wherein the measured absorbance results from light scattered by the particles of the dispersion.

32. A method of lubricating the interface between the container and a moving conveyor surface, the method comprising:

(a) forming a coating of a liquid lubricant composition on a container contact surface of a moving conveyor, the lubricant composition comprising a stable dispersion of a first liquid phase and a second liquid phase resulting in a dispersion of the first phase as droplets in a continuous second liquid phase, the resulting dispersion being transparent; and (b) moving the container on the conveyor surface in order to transport the container from a first location to a second location.

33. The method of claim 1 wherein the coating is a discontinuous lubricating coating.

34. The method of claim 1 wherein the particle size of the dispersed particles is less than 300 nm.

35. The method of claim 32 wherein the container comprises an aluminum container.

36. The method of claim 32 wherein the container comprises a thermoplastic bottle.

37. The method of claim 32 wherein the liquid lubricant is applied to the surface of the conveyor in an amount of about $2\times10^{-4}$ to 0.05 grams of lubricant per each square inch of surface.

38. The method of claim 32 wherein the thickness of the coating of lubricant comprises a minimum thickness, of an amount sufficient to provide minimum lubricating properties, up to about 5 millimeters.

39. The method of claim 32 wherein the thickness of the coating of lubricant comprises at least 0.01 millimeter.

40. The method of claim 32 wherein the thickness of the continuous thin film of lubricant comprises at least 0.1 millimeter.

41. The method of claim 36 wherein the thermoplastic bottle comprises a polyethylene terephthalate bottle or a polybutylene terephthalate bottle.

42. The method of claim 41 wherein the thermoplastic bottle has a complex curve base and the area of contact between the bottle and the lubricant is limited to the tips of the petaloid structure.

43. The method of claim 32 wherein the coefficient of friction between the container and the conveyor surface is about 0.005 to 0.14.

44. The method of claim 32 wherein the contact between the thermoplastic container and the lubricant is limited to no more than 2 millimeters of height from the conveyor surface.

45. The method of claim 32 wherein the area of the bottle in contact with the lubricant comprises about 1 to 2000 $mm^2$.

46. The method of claim 32 wherein the thickness of the coating of lubricant comprises about 0.0001 to 2 millimeters.

47. The method of claim 32 wherein the first liquid phase comprises an oleophilic liquid and the second liquid phase comprises water.

48. The method of claim 32 wherein the first liquid phase comprises an aqueous soluble material or an aqueous solution and the second liquid phase comprises an oleophilic liquid.

49. The method of claim 48 wherein the oleophilic liquid comprises a dispersion of the oleophilic liquid in an aqueous phase.

50. The method of claim 49 wherein the oleophilic liquid comprises a petroleum oil or a natural oil.

51. The method of claim 49 wherein the oleophilic material comprises a dispersion of a silicone composition in an aqueous medium.

52. The method of claim 51 wherein the mixture comprises about 0.05 to about 20 wt % of a silicone material.

53. The method of claim 52 wherein the silicone composition comprises a finely divided silicone powder, a silicone fluid, a silicone surfactant or mixtures thereof.

54. The method of claim 32 wherein the lubricant additionally comprises a water soluble lubricant comprising a polyalcohol hydroxy-containing compound selected from the group consisting of a polyalkylene glycol, a copolymer of ethylene and propylene oxide, a sorbitan ester or mixtures thereof.

55. The lubricant of claim 54 wherein the polyalcohols comprise glycerol, glycerin, or mixtures thereof.

56. The lubricant of claim 54 wherein the polyalcohols comprise propylene glycol, butylene glycol, or mixtures thereof.

57. The lubricant of claim 32 wherein the lubricant additionally comprises a cosurfactant.

58. The lubricant of claim 32 wherein the lubricant additionally comprises a solvent.

59. The method of claim 51 wherein the silicone comprises a polydimethylsiloxane, a polyalkylsiloxane, a polyphenylsiloxane or mixtures thereof.

60. The method of claim 32 wherein the particle size of the microemulsion dispersed particles is less than about 80 nm.

61. The method of claim 32 wherein the particle size of the microemulsion dispersed phase is about 1 to 75 nm.

62. The method of claim 32 wherein the lubricant is diluted with about 1 to 1000 parts of diluent per each 1 part lubricant.

63. The method of claim 32 wherein the lubricant is diluted with about 1 to 500 parts of diluent per each 1 part lubricant.

64. The method of claim 32 wherein the lubricant is diluted with about 1 to 20 parts of diluent per each 1 part lubricant.

65. The method of claim 32 wherein the lubricant is diluted with about 1 to 5 parts of diluent per each 1 part lubricant.

66. The method of claim 62 wherein the diluent is deionized water.

67. The method of claim 62 wherein the lubricant is diluted with about 1 to 100 parts of diluent per each 1 part of lubricant.

68. The method of claim 41 wherein the thermoplastic bottle has a champagne base.

69. The method of claim 41 wherein the thermoplastic bottle has a petaloid base.

* * * * *